US007403187B2

(12) United States Patent
Hewlett et al.

(10) Patent No.: US 7,403,187 B2
(45) Date of Patent: Jul. 22, 2008

(54) GENERALIZED RESET CONFLICT RESOLUTION OF LOAD/RESET SEQUENCES FOR SPATIAL LIGHT MODULATORS

(75) Inventors: Gregory J. Hewlett, Richardson, TX (US); Harold E. Bellis, II, Garland, TX (US)

(73) Assignee: Texas Instruments Incorporated, Dallas, TX (US)

( * ) Notice: Subject to any disclaimer, the term of this patent is extended or adjusted under 35 U.S.C. 154(b) by 556 days.

(21) Appl. No.: 10/753,912

(22) Filed: Jan. 7, 2004

(65) Prior Publication Data

US 2005/0146542 A1 Jul. 7, 2005

(51) Int. Cl.
*G09G 3/34* (2006.01)

(52) U.S. Cl. ..... 345/108; 345/85; 345/691

(58) Field of Classification Search ..... 345/85, 345/87, 89, 94, 98, 103, 108, 204, 690, 691
See application file for complete search history.

(56) References Cited

U.S. PATENT DOCUMENTS

| | | | | |
|---|---|---|---|---|
| 5,278,652 A | | 1/1994 | Urbanus et al. | |
| 5,497,172 A | * | 3/1996 | Doherty et al. | 345/85 |
| 5,619,228 A | * | 4/1997 | Doherty | 345/693 |
| 5,737,038 A | * | 4/1998 | Gale et al. | 348/759 |
| 6,008,785 A | * | 12/1999 | Hewlett et al. | 345/85 |
| 6,057,816 A | * | 5/2000 | Eckersley | 345/85 |

FOREIGN PATENT DOCUMENTS

| | | |
|---|---|---|
| EP | 0 685 830 A1 | 12/1995 |
| WO | WO 95/28696 | 10/1995 |

* cited by examiner

*Primary Examiner*—Richard Hjerpe
*Assistant Examiner*—Tom V Sheng
(74) *Attorney, Agent, or Firm*—Dawn V. Stephens; W. James Brady, III; Frederick J. Telecky, Jr.

(57) ABSTRACT

Disclosed herein are methods for providing a load/reset sequence for a visual display system (100) having a phased reset spatial light modulator (SLM) (14). The SLM (14) has pixels (21) that are addressable with data by means of loads (ld) and resets (r), where the data is formatted in bit-planes (0-14)and each bit-plane is loaded as one or more segments ($S_0$-$S_5$) in a predetermined sequence during a frame-time. In one embodiment, the method comprises storing a display order of the segments ($S_0$-$S_5$) and determining whether resetting any of the segments ($S_0$-$S_5$) conflicts with the resetting of another of the segments ($S_0$-$S_5$), thereby identifying a conflicting segment. The method further includes skewing the display time of the conflicting segment to avoid the reset conflict, and identifying in the sequence a segment before and a segment after the conflicting segment each affected by the skewing of the conflicting segment, where the segments before and after the conflicting segment are each of respective bit-planes comprising multiple segments in the sequence. In this embodiment, the method further comprises counter-skewing the display times of segments respectively corresponding to the segments before and after the conflicting segment. Then, the method includes setting start times for each load (ld) and reset (r) of each of the segments ($S_0$-$S_5$).

20 Claims, 6 Drawing Sheets

GENERALIZED RESET CONFLICT RESOLUTION OF LOAD/RESET SEQUENCES FOR SPATIAL LIGHT MODULATORS

TECHNICAL FIELD

Disclosed embodiments herein relate generally to SLM-based visual display systems employing digital micro-mirror devices, and more particularly to methods for providing load/reset sequences having generalized reset conflict resolution for such display systems.

BACKGROUND

Video display systems based on spatial light modulators (SLMs) are increasingly being used as an alternative to display systems using cathode ray tubes (CRTs). SLM systems provide high-resolution displays without the bulk and power consumption of CRT systems. As used for image display applications, SLMs include arrays of micro-mirrors that reflect light to an image plane. These micro-mirrors are often referred to as picture elements or "pixels", as distinguished from the pixels of an image. This use of terminology is typically clear from context, so long as it is understood that more than one pixel of the SLM array may be used to generate a pixel of the displayed image.

Digital micro-mirror devices (DMDs) are a type of SLM, and may be used for either direct-view or projection display applications. A DMD has an array of hundreds or even thousands of micro-mechanical pixels, each having a tiny mirror that is individually addressable by an electronic signal. Depending on the state of its addressing signal, each pixel tilts so that it either does or does not reflect light to the image plane.

Generally, projecting an image from an array of pixels is accomplished by loading memory cells connected to the pixels. Once each memory cell is loaded, the corresponding pixels are reset so that each one tilts in accordance with the ON or OFF state of the data in the memory cell. For example, to produce a bright spot in the projected image, the state of the pixel may be ON, such that the light from that pixel is directed out of the SLM and into a projection lens. Conversely, to produce a dark spot in the projected image, the state of the pixel may be OFF, such that the light is directed away from the projection lens.

To achieve intermediate levels of illumination, between white (ON) and black (OFF), pulse-width modulation (PWM) techniques may be employed. The basic PWM scheme involves first determining the rate at which images are to be presented to the viewer. This establishes a frame rate and a corresponding frame-time or frame period. For example, in many modern television systems images are transmitted at 60 frames per second (i.e., 60 Hz), and each frame lasts for approximately 16.67 milliseconds. Then, the intensity resolution for each pixel is established. In a simple example, and assuming n bits of resolution, the frame-time is divided into $2^{n-1}$ equal time slices. For a 16.67 millisecond frame period and n-bit intensity values, the time slice is $16.67/(2^{n-1})$ milliseconds.

Having established these times, for each frame of the desired image pixel intensities are quantized, such that black is 0 time slices, which is the intensity level represented by the least significant bit (LSB). The LSB is the least amount of illumination intensity from the DMD and is 1 time slice, while maximum brightness, e.g., the most significant bit (MSB), is $2^{n-1}$ time slices. Each pixel's quantified intensity determines its on-time during a frame period. Thus, during a frame period, each pixel with a quantized value of more than 0 is ON for the number of time slices that correspond to its intensity. The viewer's eye integrates the pixel brightness so that the image appears as if it were generated with analog levels of light.

For generating color images with SLMs, one approach is to use three DMDs, one for each primary color of red, green, and blue (RGB). The light from corresponding pixels of each DMD is converged so that the viewer perceives the desired color. Another approach is to use a single DMD and a color wheel having sections of primary colors. Data for different colors is sequenced and synchronized to the color wheel so that the eye integrates sequential images into a continuous color image. Another approach uses two DMDs, with one switching between two colors and the other displaying a third color. Of course, other approaches are also being employed.

For addressing SLMs, PWM calls for the data to be formatted into "bit-planes," each bit-plane corresponding to bit-weights of intensity values. Thus, if each pixel's intensity is represented by an n-bit value, each frame of data has n bit-planes. Each bit-plane has a 0 or 1 value for each display element. In the simple PWM example described above, during a frame period, each bit-plane is separately loaded and the pixels are addressed according to their associated bit-plane values. For example, the bit-plane representing the LSBs of each pixel is displayed for 1 time slice, whereas the bit-plane representing the MSBs is displayed for 2n/2 time slices. Because a time slice is only $16.67/(2^{n-1})$ milliseconds, the SLM must be capable of loading the LSB bit-plane (which is the shortest bit-plane) within that time. The time for loading the LSB bit-plane is the "peak data rate." In conventional systems, when the LSB is less than the load-time of the DMD, then that bit cannot be used and image quality and efficiency suffers.

U.S. Pat. No. 5,278,652, entitled "DMD Architecture and Timing for Use in a Pulse-Width Modulated Display System," which is commonly assigned with the present disclosure and incorporated hereby by reference, describes PWM for addressing a DMD in a DMD-based display system. It is directed to "global reset" methods, where bit-plane data is loaded during the preceding display time of another bit-plane. To begin the display time, the pixels of the entire array are reset simultaneously. Another method of SLM addressing is "divided" or "phased" reset addressing. With this approach, the pixels are divided into groups, but each pixel has its own memory cell. After the memory cells of one group are loaded with their data from a bit-plane, memory cells of a next group are loaded with their data. This continues until all groups have been loaded with data for the same bit-plane. Such "phased" loading is followed by a "phased reset" so that all groups consecutively begin their display of the bit-plane. Such a method is described in U.S. Pat. No. 6,201,521, entitled "Divided Reset for Addressing Spatial Light Modulator", which is commonly assigned with the present disclosure and incorporated hereby by reference in its entirety.

Unfortunately, when phased reset techniques are employed to operate the pixels in distinct groups, "reset conflicts" will typically occur. A reset conflict occurs when reset signals in any two or more groups of pixels overlap in time. Specifically, each reset command for a block requires a predetermined amount of time to complete before another block may be reset. As such, several techniques are available to overcome or avoid these conflicts, and should be employed when possible to help ensure the display system operates at peak efficiency. However, even when employing available conflict resolution techniques, not all potential conflicts may be prevented, depending on the bit-plane values and arrangement of bit segments in each bit sequence. Moreover, when short bit segments are present in the sequence, the likelihood that the resets for the shorter segments will cause a conflict increases since shorter bit segments require resetting sooner, and thus more often, than longer bit segments. As a result, such conventional resolution techniques may be even more ineffective when short bit segments are employed.

BRIEF SUMMARY

Disclosed herein are methods for providing a load/reset sequence for a visual display system having a phased reset spatial light modulator (SLM). The SLM has pixels that are addressable with data by means of loads and resets, where the data is formatted in bit-planes and each bit-plane is loaded as one or more segments in a predetermined sequence during a frame-time.

In one embodiment, the method comprises storing a display order of the segments and determining whether resetting any of the segments conflicts with the resetting of another of the segments, thereby identifying a conflicting segment. The method further includes skewing the display time of the conflicting segment to avoid the reset conflict, and identifying in the sequence a segment before and a segment after the conflicting segment each affected by the skewing of the conflicting segment, where the segments before and after the conflicting segment are each of respective bit-planes comprising multiple segments in the sequence. In this embodiment, the method further comprises counter-skewing the display times of segments respectively corresponding to the segments before and after the conflicting segment. Then, the method includes setting start times for each load and reset of each of the segments.

In another embodiment, a method comprises storing a display order of the segments, and determining whether resetting any of the segments conflicts with the resetting of another of the segments, thereby identifying a conflicting segment. This embodiment further comprises skewing the display time of all of the segments in the sequence to avoid the reset conflict, and then setting start times for each load and reset of each of the segments.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF PREFERRED EMBODIMENTS

Figure 1:
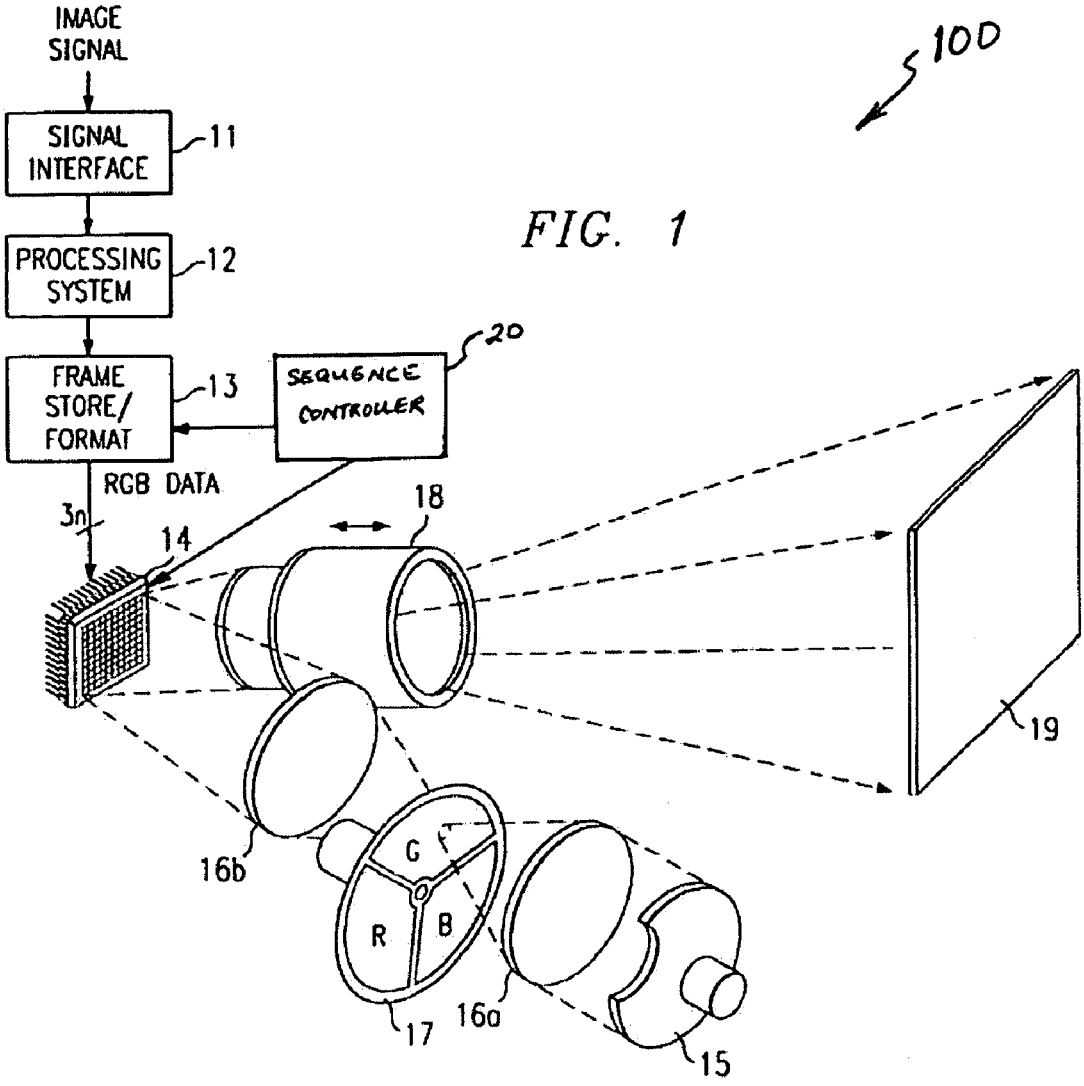
FIG. 1 illustrates one embodiment of a projection visual display system, which uses an SLM having a DMD therein to generate real-time images from an input signal.

Referring initially to FIG. 1, illustrated is one embodiment of a projection visual display system 100, which uses an SLM having a DMD 14 therein to generate real-time images from an input signal. The input image signal may be from a television tuner, MPEG decoder, video disc player, video cassette player, PC graphics card, or the like. Only those components significant to main-screen pixel data processing are shown. Other components, such as might be used for processing synchronization and audio signals or secondary screen features, such as closed captioning, are not shown for simplicity.

In the illustrated embodiment, an input image signal, which may be an analog or digital signal, is input to a signal interface unit 11. In embodiments where the input signal is analog, an analog-to-digital converter (not illustrated) may be employed to convert the incoming signal to a digital data signal. Signal interface unit 11 receives the data signal and separates video, synchronization, and audio signals. In addition, a Y/C separator is also typically employed, which converts the incoming data from the image signal into pixel-data samples, and which separates the luminance ("Y") data from the chrominance ("C") data, respectively. Alternatively, in other embodiments, Y/C separation could be performed before A/D conversion.

The separated signals are then input to a processing system 12. Processing system 12 prepares the data for display, by performing various pixel data processing tasks. Processing system 12 may include whatever processing components and memory useful for such tasks, such as field and line buffers. The tasks performed by the processing system 12 may include linearization (to compensate for gamma correction), colorspace conversion, and interlace to progressive scan conversion. The order in which any or all of the tasks performed by the processing system 12 may vary.

Once the processing system 12 is finished with the data, a display memory module 13 receives processed pixel data from the processing system 12. The display memory module 13 formats the data, on input or on output, into bit-plane format, and delivers the bit-planes to the SLM. As discussed in the Background section, the bit-plane format permits single or multiple pixels on the DMD 14 to be turned on or off in response to the value of one bit of data, in order to generate one layer of the final display image. In one embodiment, the display memory module 13 is a "double buffer" memory, which means that it has a capacity for at least two display frames. In such a module, the buffer for one display frame may be read out to the SLM while the buffer for another display frame is being written. To this end, the two buffers are typically controlled in a "ping-pong" manner so that data is continuously available to the SLM.

For the next step in generating the final desired image, the bit-plane data from the display memory module 13 is delivered to the SLM. Although this description is in terms of an SLM having a DMD 14 (as illustrated), other types of SLMs could be substituted into display system 100. Details of a suitable SLM are set out in U.S. Pat. No. 4,956,619, entitled "Spatial Light Modulator", which is commonly owned with the present disclosure and incorporated herein by reference in its entirety. In the case of the illustrated DMD-type SLM, each piece of the final image is generated by one or more pixels of the DMD 14, as described above. Generally, the SLM uses the data from the display memory module 13 to address each pixel on the DMD 14. The "ON" or "OFF" state of each pixel forms a black or white piece of the final image, and an array of pixels on the DMD 14 is used to generate an entire image frame. Each pixel displays data from each bit-plane for a duration proportional to each bit's PWM weighting, which is proportional to the length of time each pixel is ON, and thus its intensity in displaying the image. In the illustrated embodiment, each pixel of DMD 14 has an associated memory cell to store its instruction bit from a particular bit-plane.

For each frame of the image to be displayed in color, Red, Green, Blue (RGB) data may be provided to the DMD 14 one color at a time, such that each frame of data is divided into red, blue, and green data segments. Typically, the display time for each segment is synchronized to an optical filter, such as a color wheel 17, which rotates so that the DMD 14 displays the data for each color through the color wheel 17 at the proper time. Thus, the data channels for each color are time-multiplexed so that each frame has sequential data for the different colors. Depending on the system, such color wheels may include only primary color segments, or may even have white segments or both primary and secondary color segments. Moreover, in systems employing neutral-density (ND) color filtering, the color wheel 17 may include additional sections for illuminating ND versions (i.e., decreased intensity) of the basic RGB colors. A detailed description of ND filtered illumination using a color wheel may be found in U.S. Pat. No. 5,812,303, which is commonly owned with the present disclosure and incorporated herein by reference in its entirety.

For a sequential color system, such as the system 100 illustrated in FIG. 1, a light source 15 provides white light through a condenser lens 16*a*, which focuses the light to a point on the rotating color wheel 17. A second lens 16*b* may be employed to fit the colored light output from the color wheel 17 to the size of the pixel array on the DMD 14. Reflected light from the DMD 14 is then transmitted to a display lens 18. The display lens 18 typically includes optical components for illuminating an image plane, such as a display screen 19.

In an alternative embodiment, the bit-planes for different colors could be concurrently displayed using multiple SLMs, one for each color component. The multiple color displays may then be combined to create the final display image. Of course, a system or method employing the principles disclosed herein is not limited to either embodiment.

Also illustrated in FIG. 1 is a sequence controller 20 associated with the display memory module 13 and the DMD 14. The sequence controller 20 provides reset control signals to the DMD 14, as well as load control signals to the display memory module 13. These signals are typically ordered in a sequence generated in accordance with the principles disclosed below. An example of a suitable sequence controller is described in U.S. Pat. No. 6,115,083, entitled "Load/Reset Sequence Controller for Spatial Light Modulator", which is commonly owned with the present disclosure and incorporated herein by reference in its entirety.

Figure 2:
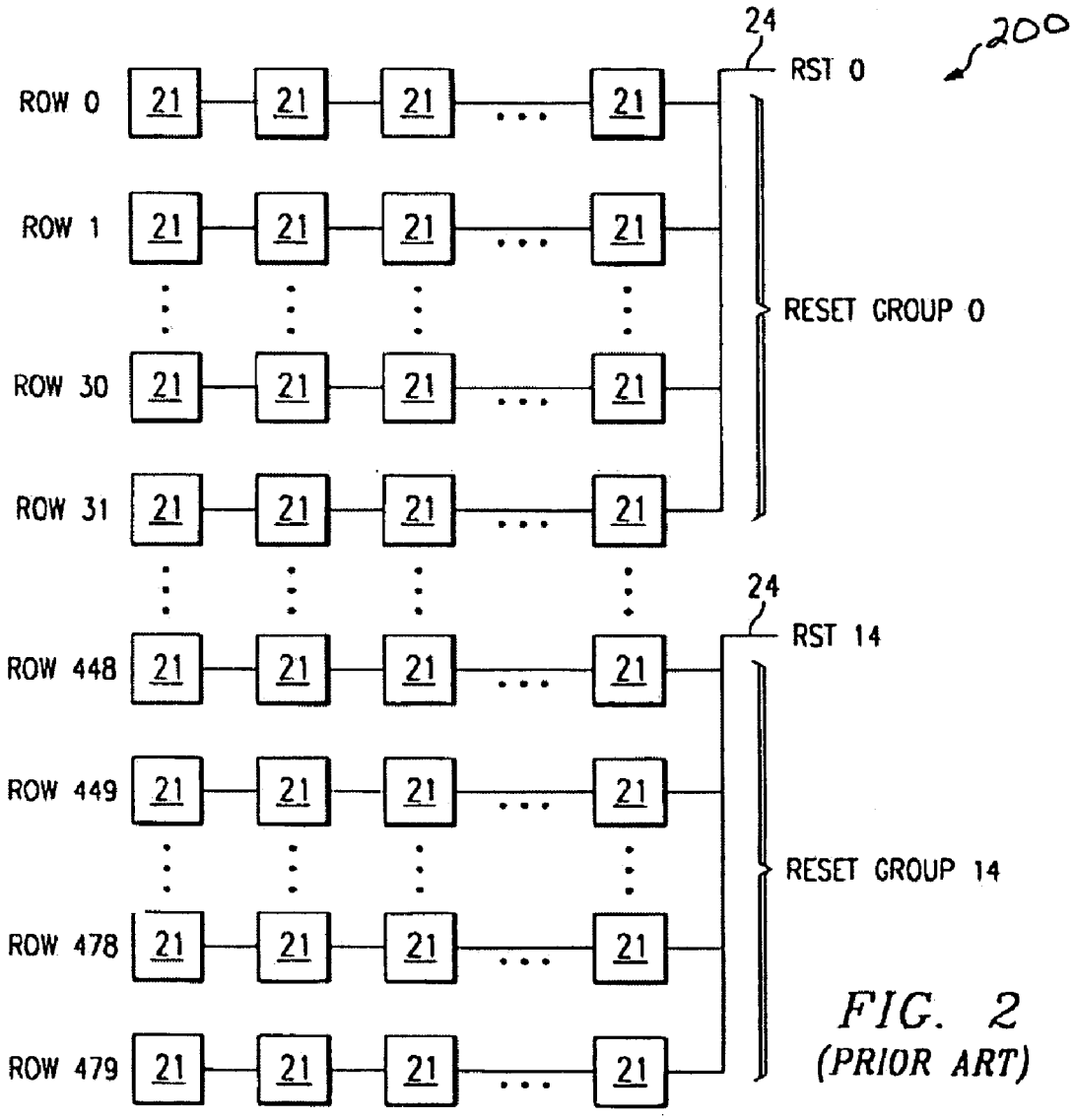
FIG. 2 (PRIOR ART)
FIG. 2 illustrates a portion of the array of micro-mirrors found on DMD in FIG. 1.

Turning now to FIG. 2, illustrated is a portion of the array 200 of micro-mirrors (i.e., "pixels") 21 found on DMD 14 in FIG. 1. In the illustrated embodiment, the array 200 are configured for divided or "phased" reset addressing. As explained below, addressing the pixels 21 typically requires that each pixel's 21 memory cell be loaded with data derived from bit sequences for each bit-plane of the desired image, and that each pixel 21 be reset between loads to operate the pixels 21 in accordance with that data. When operated, the pixels 21 display the data by being ON or OFF for a display time that corresponds to the intensity of light that each pixel 21 generates.

Although only a small number of pixels 21 are illustrated in FIG. 2, the DMD 14 typically has additional rows and columns of pixels 21, as illustrated by the ellipses. The mirror array 200 of a typical DMD 14 has hundreds or even thousands of display pixels 21, each usually with its own memory cell. As shown, the array 200 may be divided into "reset groups" of pixels 21, which are defined by which pixels 21 are connected to a single reset line 24. In the example of FIG. 2, each thirty-two consecutive rows of pixels 21 are connected to a single reset line 24, and are thus a separate group. For example, if a 480-row DMD 14 has thirty-two rows per group, as illustrated, then there are fifteen groups of pixels 21. The bit-plane data for each of the groups is formatted into group data. Thus, where p is the number of active pixels 21 on the DMD 14 and q is the number of groups, a bit-plane having p number of bits is formatted into q groups of data. Therefore, each group of pixels 21 has p/q bits of data.

In many embodiments, the number of groups into which a mirror array 200 is arranged is somewhat arbitrary. In general, the minimum bit-plane display time is inversely proportional to the number of groups. On one hand, shorter bit-times are often desirable because they allow better flexibility for mitigating visual artifacts. However, on the other hand, overall complexity of the display system increases with more groups because of the need for additional drive circuits, package pins, and control circuitry. In general, however, the principles described herein apply to a DMD 14 having any number of groups. Moreover, the rows in each group need not be consecutive, and any pattern is possible, such as an interleaved pattern of every $n^{th}$ row for n number of reset lines. Furthermore, the pattern could be in vertical or diagonal rows, and the pattern need not be row-by-row, but rather in blocks, contiguous or interleaved.

Figure 3:
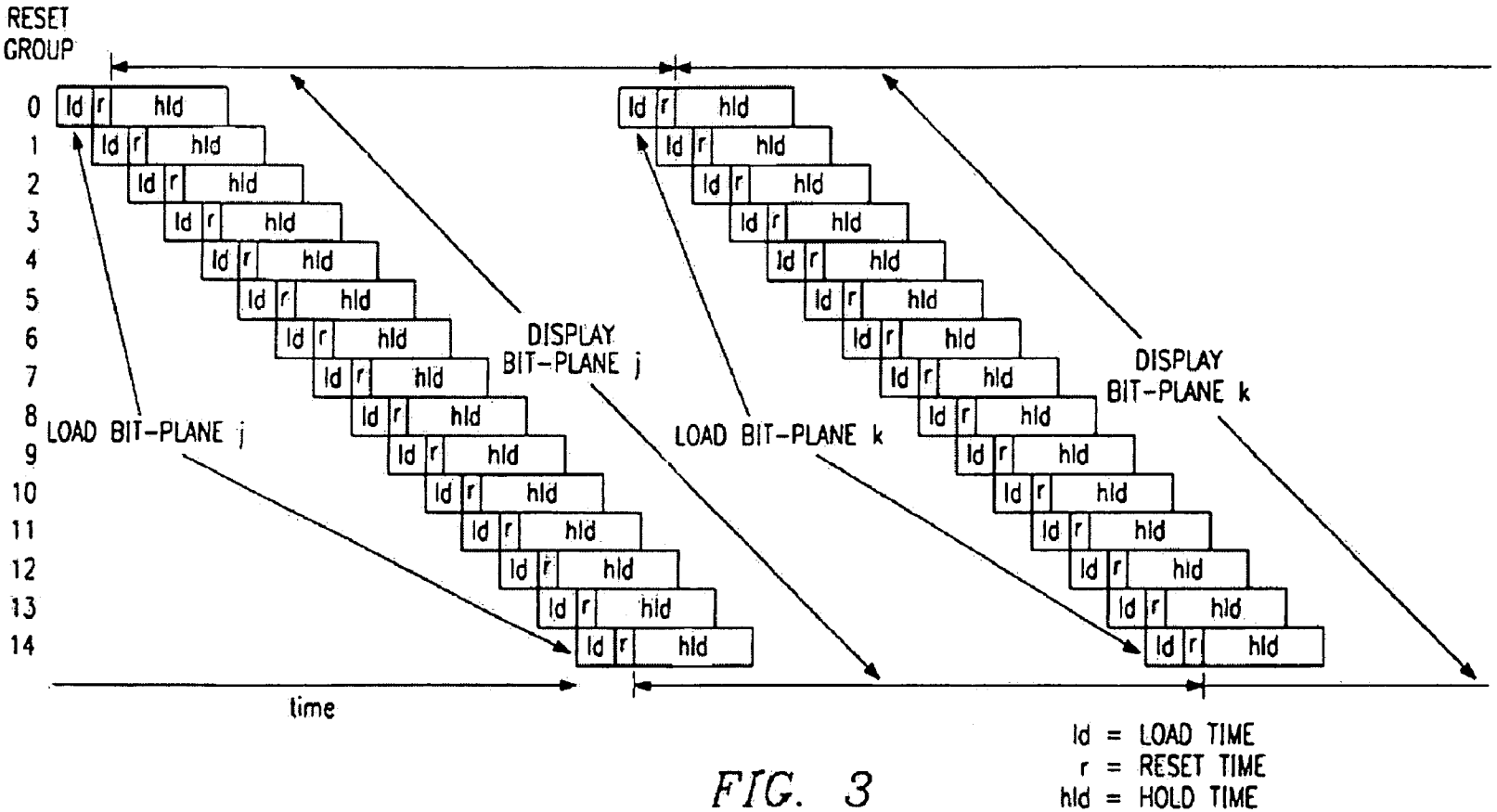
FIG. 3 (PRIOR ART)
FIG. 3 illustrates an example of phased resetting using the fifteen groups of pixels shown in FIG. 2.

Looking now at FIG. 3, illustrated is an example of phased resetting using the fifteen groups of pixels 21 shown in FIG. 2. More specifically, the fifteen groups of pixels 21 are loaded and reset for displaying of a bit-plane "j". Each group is first loaded with data, during a load-time (ld). Then, the pixels 21 for each loaded group are reset. The reset time (r) represents the time when a reset signal is applied on the reset line connected to each particular group. The reset signal causes each pixel 21 in the group to change state in accordance with the data stored in its memory cell. After being reset, the group begins its display time, where at the beginning of the display time, the pixels 21 undergo a hold-time (hld) during which the data should be kept stable.

As soon as one group is loaded, loading of the next group may begin. Such loading, resetting, and displaying process is repeated for each of the fifteen groups, such that after each group is loaded, the loading of the next group begins while the previous group is being reset and displayed. In the embodiment in FIG. 3, the load and reset for each group occurs consecutively, resulting in a phased reset, as distinguished from a "global" reset where all of the groups are reset concurrently once each has been loaded. By employed a phased reset, the display times of the groups for the bit-plane are skewed at the beginning and end of the display time. However, the viewer perceives each pixel's ON-time as if all pixels were on simultaneously for the bit-time.

In this embodiment, the reset of each group occurs immediately after the loading of that group. As a result, the display time is as long as the total time to load all groups, typically referred to a "nominal" display time. In the particular example of FIG. 3, the display time for bit-plane j is the same as the time to load all 15 groups, e.g., from the reset of Group 0 to the reset of Group 14. Of course, a nominal display time is not required and the time between load and reset may be delayed for each reset group, which provides shorter display times. Alternatively, loading may be non-continuous, which provides longer display times. Also, the time between load and reset need not be the same among reset groups, which makes it possible to align the resets rather than skew them at the beginning of a bit-plane display time.

Figure 3A:
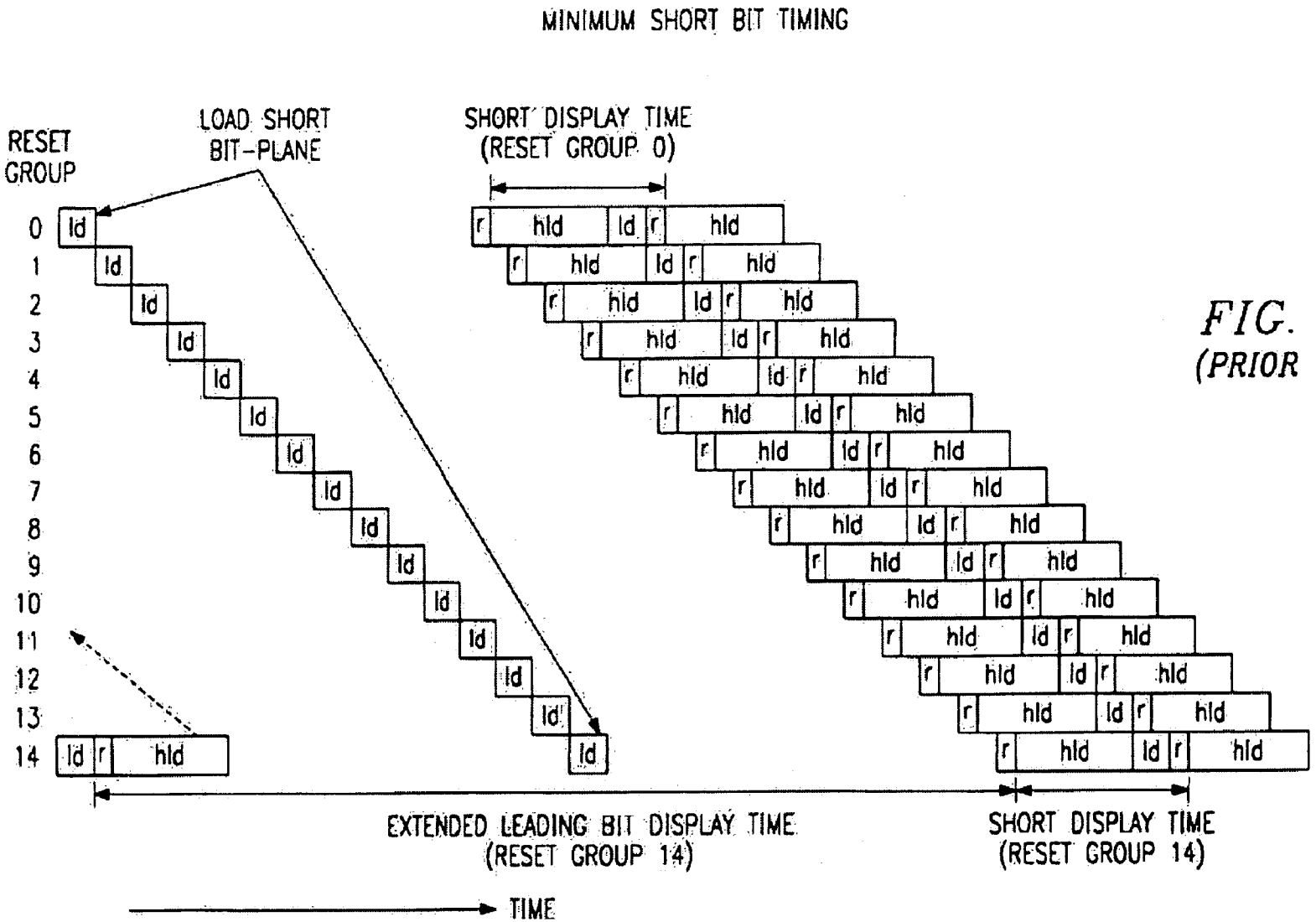
FIG. 3A (PRIOR ART)

Turning briefly to FIG. 3A, illustrated is another example of phased resetting using the fifteen groups shown in FIG. 2, where display times shorter than the nominal display time are accomplished. Specifically, for shorter display times, the resets may be delayed with respect to the loading of bit sequence data. Additionally, the time between load and reset need not be the same for each of the groups. As a result, it is possible to align the resets, rather than skew them at the beginning of a bit-plane display time, as mentioned above. Examples of various phased reset addressing, including those embodiments discussed above, are discussed in U.S. Pat. No. 6,201,521, which is commonly owned with the present disclosure and incorporated herein by reference in its entirety.

For load/reset sequence generation, a sequence controller, such as the controller 18 described above, is programmed with a sequence of loads and reset instructions. The "sequence" is the particular order, for a frame period, of loads and resets for all the groups. For example, relative to time 0, a portion of a reset sequence might include the following two instructions:

reset [170,1]
reset [16,2]

where the argument is [delay, group number]. A portion of a load sequence might include the following two instructions:

load [300,5]
load [198,6]

where the argument is [delay, bit-plane number]. Usually, a load of a bit-plane occurs without interruption for all groups. In such an embodiment, no group designations are necessary, it being implied that a load instruction is for a continuous series of all groups. However, the loads of groups for a bit-plane may also be independently initiated.

The reset sequence and the load sequence are coordinated with each other so that loads and resets occur at the proper times. In the above examples of reset and load sequences, the delays are from a common reference. The sequence programmed into the sequence controller 18 is the result of a sequence generation process discussed in several of the references cited above. A computer that is programmed in accordance with the principles disclosed herein typically performs such a sequence generation process. A computer so programmed may be referred to herein as a "sequence generator", and may be a general purpose or a dedicated computer.

Figure 4:
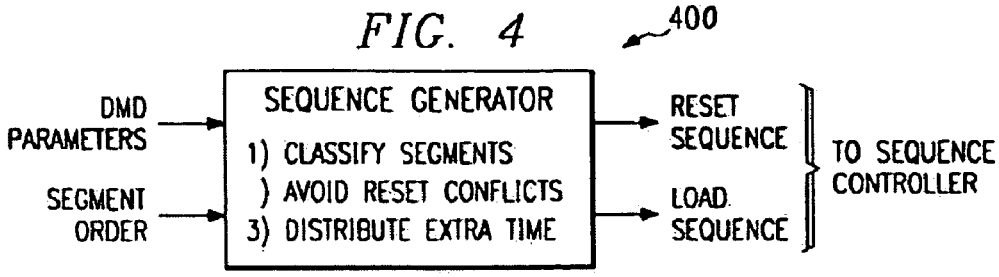
FIG. 4 illustrates a sequence generator that may be employed to generate loads and resets in accordance with the principles disclosed herein.

Referring now to FIG. 4, illustrated is a sequence generator 400 that may be employed to generate loads and resets in accordance with the principles disclosed herein. Specifically, the sequence generator 400 generates a sequence of resets and loads and their relative timing. To generate valid loads and resets, the sequence generator 400 takes into consideration certain incoming data, as well as classifying segments, preventing reset signals of different groups from overlapping (i.e., "reset conflicts"), and distributing "extra time" of certain segments.

Among the data input to the sequence generator 400, "DMD parameters" represent various constraints and dynamics of the DMD 14 that affect resets and loads. Such DMD parameters determine the classification of the segment to be reset or loaded. In addition, the order of segments is also input to the sequence generator 400. The "segment order" is the order in which segments are loaded (and therefore displayed) during a frame-time. A bit-plane having multiple segments is typically loaded multiple times. As such, each bit-plane as data for the series of groups may be delivered, for example, as a segment of the MSB, then a segment of the MSB-2, then the segment for the LSB, then another segment of the MSB, etc, until all segments for all bit-planes are loaded. Table 1 illustrates various DMD parameters that may be used by a sequence generator 400. Such parameters are typically employed in a visual display system having a color wheel that has more than one section per color. In such embodiments, each color has a frame-time (or frame period) that is a portion of the total time for one revolution of the color wheel. Moreover, each color has a sequence for each of its color wheel sections.

TABLE 1

| PARAMETER | DESCRIPTION |
|---|---|
| reset time | time for a normal reset sequence |
| reset | time for a reset sequence |
| release time | time without associated bias on |
| bias on-time | time to activate the bias |
| data hold-time | time after initiation of bias ON after which a load is allowed |
| reset release hold-time | time between reset release and bias ON |
| mirror transit-time | time used to allow for transition of a mirror |
| data setup-time | required time after a load completes after which a reset may be initiated |
| clear time | required time to globally clear device |
| group load-time | time required to load a group |
| minimum r to r time | minimum time between two reset operations |
| frame-time | total time to be taken by all bit-planes of the sequence |
| used frame-time | total time that light will be perceived during a frame |
| number of reset groups | number of groups into which the DMD array is divided |
| color wheel sections | number of colors on the color wheel |
| section-time | time to be taken by each color wheel section |

Figure 5:
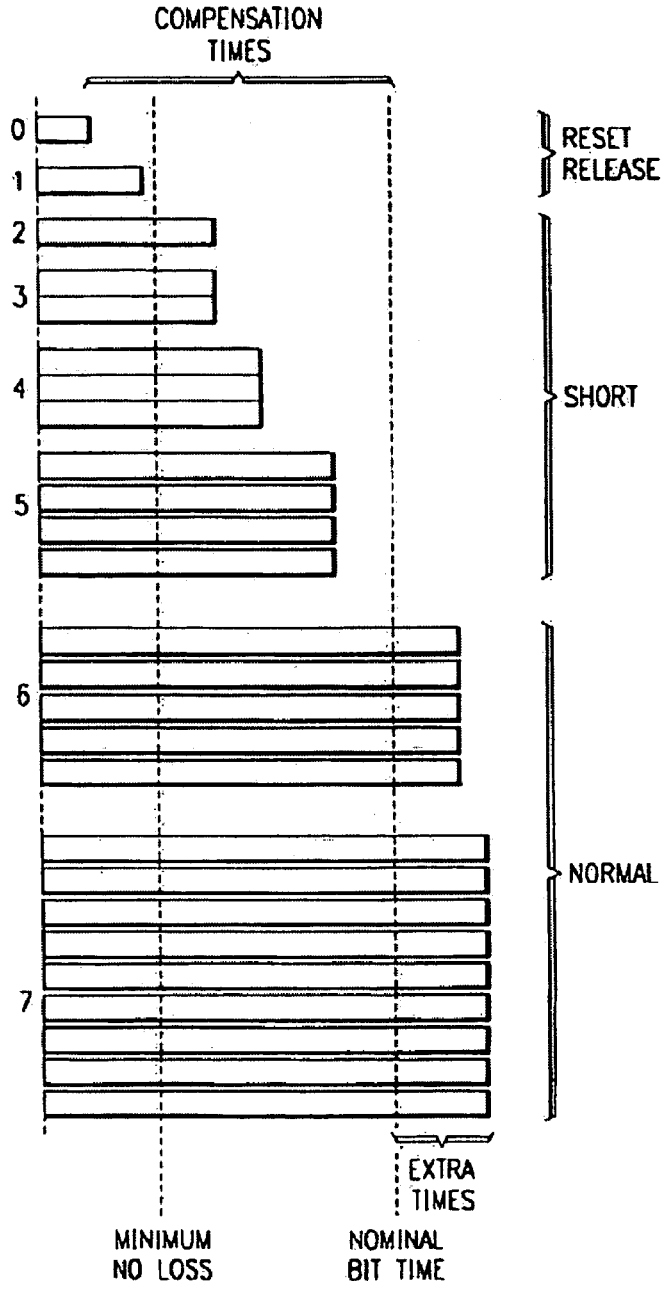
FIG. 5 illustrates bit-plane segments for 8-bit pixel values, as well as their classification.

Turning now to FIG. 5, illustrated are bit-plane segments for 8-bit pixel values, as well as their classification. As mentioned above, a bit-plane is typically displayed as one or more segments. When a bit-plane has multiple segments, its display time is divided and distributed within the frame period. Typically, the bit-plane(s) of one or more of the more significant bits are segmented. If a bit-plane has multiple segments, typically the segments are equal in length and have the same type, but this is not necessarily the case. In the embodiment of FIG. 5, bit-planes 3-7 have multiple segments.

Classification is based on the initial display times of segments. In general, there are three classes of segments (corresponding to three classes of display times): (1) normal, (2) short, and (3) reset release. Normal display times are as long or longer than a "nominal" display time. Referring back to FIG. 3, a nominal display time is equal to the time required to load the DMD when all groups are loaded sequentially, one immediately after the other. This permits the loading of a segment into all the groups while the previously loaded segment is being displayed on all groups (e.g., phased). Conversely, short and reset-release display times are shorter than the nominal display time.

Turning briefly back to FIG. 3A, short display times may be achieved by delaying the resets with respect to the loads of a particular segment. If resets are delayed until the end of the hold-time meets the start of the next load, the short display time may be as short as the sum of the reset-time, hold-time, group load-time, and data setup-time. Reset-release display times are shorter than the sum of the reset-time, hold-time, group load-time, and data setup-time. A reset-release display time is terminated with a reset-release pulse so that the pixels "float" between an ON or OFF state. During this float time, the next bit-plane may be loaded before a bias is re-applied to operate the pixel.

Now looking again at FIG. 5, the segments of bit-plane 7 (which is the MSB in this embodiment) and bit-plane 6 are normal segments. In contrast, the segments of bit-planes 5, 4, 3, and 2 are short segments. The segments of bit-planes 1 and 0 are reset-release segments. Finally, "extra time" (as mentioned with respect the FIG. 4, as well) is time beyond the nominal display time. Conversely, "compensation time" is the time that would be required to make a segment have a nominal display time. In the example of FIG. 5, the segments of bit-planes 6 and 7 have extra time, while the other segments need compensation time. With all of this data, the sequence generator may then provide bit sequences for the various bit-planes that meet the constraints of the DMD parameters.

Figure 6:
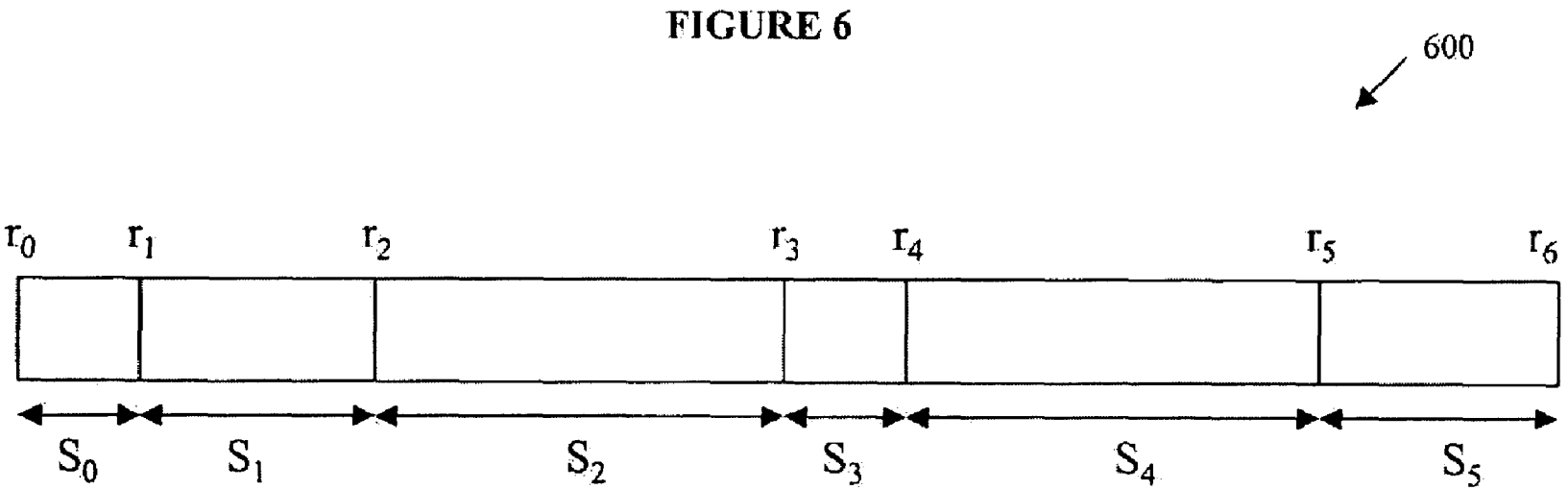
FIG. 6 illustrates one embodiment of a bit sequence comprised of six segments from a variety of bit-planes.

Turning now to FIG. 6, illustrated is one embodiment of a bit sequence 600 comprised of six segments from a variety of bit-planes. Typically, the bit sequence 600 is a portion of a larger sequence that has been "split" in accordance with one of the references cited above. Of course, a display system employing the disclosed processes is not limited to any particular type of bit sequence.

The illustrated bit sequence 600 may be used to demonstrate various embodiments of the disclosed processes, as detailed below. Moreover, the illustrated sequence 600 represents a load/reset sequence for a visual display system having a phased-reset SLM, where the SLM has numerous pixels addressable with data by means of loads and resets. The data is presented in the form of bit-planes, where each of the bit-planes is loaded as one or more bit segments in a predetermined sequence executed during a frame-time. Select pixels are then addressed with the bit-plane data in accordance with the sequence 600 to generate the desired image.

As mentioned above, a reset conflict occurs when reset signals in any two or more groups of pixels overlap in time. For example, for short segments, where resets are typically delayed, the resets for the next segment could begin before all the resets of the short segments are finished. This could result in one or more overlaps between resets of the two segments, occurring in different groups. Potential reset conflicts can be determined by calculations based on the segment display times and the reset times. As mentioned in U.S. Pat. No. 6,008,785, cited above, several popular techniques for resolving such reset conflicts exist today.

Among some of the techniques is the use of "skewing" the display time (or hold time) of the conflicting bit segment such that it no longer conflicts with another reset. When employing such skewing, however, the linearity of the remaining bit segments is also impacted. As a result, the skewing of the conflicting bit segment should be compensated for in another part of the same bit sequence. One type of compensation is commonly known as "sandwich-skewing". This approach to skewing may be employed when the two bit segments adjacent the conflicting bit segment are both of the same bit-plane. For example, looking at FIG. 6, assuming $S_3$ was a conflicting bit segment, then bit segments $S_2$ and $S_4$ would typically have to be equal for sandwich skewing to be available. If those surrounding bit segments are equal, one ($S_2$) of the two equal segments may be skewed to compensate for the skewing of the conflicting bit segment ($S_3$), while the opposite amount of skewing may be done to the second ($S_4$) of the two to compensate for the skewing done to the first one. Since the two bit segment are equal, and thus are merely portions of the same larger bit-plane, then skewing the two an opposite amounts cancels each other out such that the overall linearity of the sequence is restored.

A second available skewing technique is commonly called "counter-skewing". This approach involves finding an adjacent pair of bit segments that are equivalent to the two bit segments adjacent the conflicting bit segment, but in reverse order. Since the bit segments adjacent the conflicting bit segment are both affected by a skewing of the conflicting bit segment, if an adjacent pair of the same two bit segments, but in reverse order, may be found in another part of the sequence, then the adjacent pair may be counter-skewed in a manner opposite to the affect on the adjacent pair caused by skewing the conflicting bit segment. For example, looking again to FIG. 6, assuming again that $S_3$ is a conflicting bit segment, then bit segments $S_2$ and $S_4$ would be affected by any skewing of $S_3$. If $S_2$=6 and $S_4$=7, then the adjacent pair of 7, 6 (in this order) needs to be found elsewhere in the same sequence to counter-skew for the affect on bit segments $S_2$ and $S_4$ (which are in the order 6, 7 in this example). Unfortunately, while such skewing techniques have proven to be very beneficial in formulating complex bit sequences, meeting either of the conditions needed for these skewing techniques is not always possible. While this typically leads to relying on other, less desirable conventional reset conflict resolution techniques, the disclosed techniques provide an alternative skewing approach.

The proposed generalized reset conflict resolution techniques allow the grouping of bit segments with the same skews in a manner not previously provided, such that all reset conflicts are avoided. Stated another way, instead of trying to satisfy conditions on only the immediately adjacent bit-planes of the conflicting bit segment, so that those adjacent bit segments may be skewed to resolve the conflict, the region of skewing may be expanded beyond the adjacent bit segments until two segments that do meet one of these two conditions (with respect to the remaining segments in the sequence) are found.

In one embodiment, a generalized sandwich skew is provided. In this embodiment, referring to FIG. 6, it is assumed that bit segments $S_0$-$S_6$ display a sequence of bit-planes [7 6 4 2 6 3 7] and bit segment $S_3$ is a conflicting bit segment causing a reset conflict. Table 2 illustrates the bit-plane values for the illustrated bit segments.

TABLE 2

| Bit Segment | Bit-plane |
|---|---|
| $S_0$ | 7 |
| $S_1$ | 6 |
| $S_2$ | 4 |
| $S_3$ | 2 |
| $S_4$ | 6 |
| $S_5$ | 3 |
| $S_6$ | 7 |

The bit segments adjacent either side of $S_3$ (i.e., $S_2$ and $S_4$) have values of 4 and 6, respectively, and are therefore not equal to each other. Thus, a typical sandwich skewing technique could not be employed. In addition, the above-described counter-skew technique could also not be employed since no consecutive bit segment pairs are present elsewhere in the bit sequence that display 6, 4 (in this order). As a result, a generalized conflict resolution technique, as disclosed herein, is performed looking to the left and right of the conflicting bit segment ($S_3$) until one of these conditions is met. More specifically, in this embodiment, the bit-plane of $S_1$ equals the bit-plane of $S_4$ (6=6). Thus, a generalized sandwich skew according to the disclosed principles may be done using bit segments $S_1$ and $S_4$, since these segments are equal and are located on opposite sides of the conflicting bit segment ($S_3$). Specifically, resets $r_2$, $r_3$ and $r_4$ may all be skewed by the same amount, such that reset conflicts are avoided. Beneficially, such a generalized "sandwich" skew may be accomplished even though $S_1$ and $S_4$ are not both immediately adjacent $S_3$.

In another embodiment, a generalized counter-skewing technique is provided. In this embodiment, again referring to FIG. 6, it is assumed that bit segments $S_0$-$S_6$ display bit-planes [7 5 7 5 6 2 7] and bit segment $S_5$ is a conflicting bit segment causing a reset conflict. Table 3 sets forth the bit-plane values for the bit segments in this example.

TABLE 3

| Bit Segment | Bit-plane |
|---|---|
| $S_0$ | 7 |
| $S_1$ | 5 |
| $S_2$ | 7 |
| $S_3$ | 5 |
| $S_4$ | 6 |
| $S_5$ | 2 |
| $S_6$ | 7 |

The bit segments adjacent either side of $S_3$ (i.e., $S_4$ and $S_6$) have values of 6 and 7, respectively, and therefore a sandwich skewing technique could not be employed. Likewise, the bit segments immediately adjacent the conflicting bit segment ($S_5$) are not repeated by consecutive bit segments elsewhere in the sequence of 7, 6 (in this order). Thus, a typical counter-skewing technique of the type described above may not be employed. As a result, this embodiment of the disclosed conflict resolution techniques continues looking in the sequence to the left and right of the conflicting bit segment ($S_5$) until one of the conditions is met. In this example, bit segments $S_3$ and $S_6$ (5, 7) are located on either side of the conflicting bit segment and are of the same bit-planes as segments $S_0$ and $S_1$ (7, 5), but in reverse order. Thus, all of the bit segments between $S_3$ and $S_6$ (which includes the originally skewed conflicting bit segment) are skewed, along with the reverse sequence found in bit segments $S_0$ and $S_1$. Stated another way, resets $r_1$, $r_4$, $r_5$ and $r_6$ may all be skewed the same amount, thus avoiding any conflicts, without jeopardizing the overall linearity of the bit-plane sequence 600. As a result, such a generalized counter-skewing technique may be beneficially employed, even though bit segments $S_1$ and $S_4$ are not both immediately adjacent $S_3$.

In a related embodiment, the looking to the left and right for the appropriate bit-planes can also occur at the point where the counter-skewing is added to compensate for the skewing of the conflicting bit segment. In such an embodiment, bit segments $S_0$-$S_6$ may display a sequence of bit-planes [7 6 5 4 5 2 7] with $S_5$ being the conflicting bit segment. Table 4 sets forth the bit-plane values for the bit segments in this example. In this example, the only repeatable (in reverse order) pair of bit segments is $S_4$ and $S_6$, which are adjacent the conflicting bit ($S_5$).

TABLE 4

| Bit Segment | Bit-plane |
|---|---|
| $S_0$ | 7 |
| $S_1$ | 6 |
| $S_2$ | 5 |
| $S_3$ | 4 |
| $S_4$ | 5 |
| $S_5$ | 2 |
| $S_6$ | 7 |

Unfortunately, the reversed bit-planes of bit segments $S_0$ and $S_2$ (7, 5) corresponding to the pair of $S_4$ and $S_6$ (5,7) are not adjacent each other. Instead, corresponding bit segments $S_0$ and $S_2$ have bit segment $S_1$ located therebetween. However, this does not present a problem to the disclosed generalized conflict resolution, and resets $r_1$, $r_2$, $r_5$ and $r_6$ can all be skewed to resolve the conflict.

In yet another embodiment, generalized conflict resolution may be provided by skewing an entire subsequence of bit-planes. In this embodiment, bit segments $S_0$-$S_6$ may display a sequence of bit-planes [7 5 3 4 6 2 7] with $S_5$ being the conflicting bit segment. Moreover, in this example, it is assumed that the illustrated six bit segments comprise a subsequence of a larger sequence of bit-plane values to be executed on the mirror array of an SLM. Table 5 sets forth the bit-plane values for the bit segments in this example.

TABLE 5

| Bit Segment | Bit-plane |
|---|---|
| $S_0$ | 7 |
| $S_1$ | 5 |
| $S_2$ | 3 |
| $S_3$ | 4 |
| $S_4$ | 6 |
| $S_5$ | 2 |
| $S_6$ | 7 |

In addition, this subsequence is shown as bounded by "bookend" bit segments of the same bit-plane ($S_0$ and $S_6$=7). In this case, resets $r_1$, $r_2$, $r_3$, $r_4$, $r_5$ and $r_6$ may be collectively skewed by the same amount such that the conflict is resolved. Specifically, since the bookend bit segments are of the same bit-plane, then any non-linearity resulting from skewing the entire subsequence may be compensated by these segments using opposing skews on these two bit segments.

It should be noted that for all of the various generalized conflict resolution techniques disclosed, the amount of skewing for both the conflicting bit segment, as well as the remaining segments that are implicated in the technique, is entirely open. As such, the amount of skewing for the conflicting bit segment may be carefully selected based on the amount of further skewing needed on any or all of the remaining segments in the sequence to compensate for the original amount of skew on the conflicting bit segment. In addition, while only seven bit segments are illustrated in the examples and embodiments discussed above, it should be understood that the disclosed techniques may be employed for any number of bit segments in a bit sequence, as well as for any number of bit sequences.

Furthermore, when phased-reset techniques are employed in visual display systems, shorter bit segments often tend to cause more conflicts. Specifically, since shorter bit segments require resetting sooner, and thus more often, than longer bit segments, the likelihood that the resets for the shorter segments will cause a conflict increases. Of course, as the number of reset conflicts increases, so too does the number of conflict resolutions that must take place for the SLM to operate properly, and thus the chance that conventionally available techniques are not employable. As a result, the reset conflict resolution techniques disclosed herein are particularly beneficial to sequences having short bit segments.

For example, in systems that employ neutral density filtering (NDF), multiple short bit segments are typically present in the sequence (if not all the segments) since NDF involves the lengthening of bit segments that are originally shorter than the load-time of the SLM (and thus are not useable in their original length). While NDF applications may provided substantially more chances for reset conflicts and since conventional techniques may not be sufficient to resolve all of these conflicts, the use of the conflict resolution techniques disclosed herein provide for conflict resolution opportunities beyond those available with conventional approaches. Further, such resolution is still possible even if all of the bit segments in the sequence are originally shorter than the load-time of the SLM before NDF occurs. In addition, in some NDF applications, the expanded segments caused by NDF may result in conflicts that were previously not present. The disclosed techniques are also beneficial to alleviate such resulting conflicts, and are especially beneficial in those situations where conventional techniques are unavailable.

While various embodiments of reset conflict resolution techniques according to the principles disclosed herein have been described above, it should be understood that they have been presented by way of example only, and not limitation. Thus, the breadth and scope of the invention(s) should not be limited by any of the above-described exemplary embodiments, but should be defined only in accordance with the following claims and their equivalents. Moreover, the above advantages and features are provided in described embodiments, but shall not limit the application of the claims to processes and structures accomplishing any or all of the above advantages.

Additionally, the section headings herein are provided for consistency with the suggestions under 37 CFR 1.77 or otherwise to provide organizational cues. These headings shall not limit or characterize the invention(s) set out in any claims that may issue from this disclosure. Specifically and by way of example, although the headings refer to a "Technical Field," the claims should not be limited by the language chosen under this heading to describe the so-called technical field. Further, a description of a technology in the "Background" is not to be construed as an admission that technology is prior art to any invention(s) in this disclosure. Neither is the "Brief Summary" to be considered as a characterization of the invention(s) set forth in the claims found herein. Furthermore, any reference in this disclosure to "invention" in the singular should not be used to argue that there is only a single point of novelty claimed in this disclosure. Multiple inventions may be set forth according to the limitations of the multiple claims associated with this disclosure, and the claims accordingly define the invention(s), and their equivalents, that are protected thereby. In all instances, the scope of the claims shall be considered on their own merits in light of the specification, but should not be constrained by the headings set forth herein.

What is claimed is:

1. A method for providing a load/reset sequence for a display system having a phased reset spatial light modulator having pixels addressable with data by means of loads and resets and having a minimum load-time, the data being formatted in bit-planes, the bit-planes each loaded as one or more segments in a predetermined sequence during a frame-time, the method comprising:

storing a display order of the segments;

determining whether resetting any of the segments conflicts with the resetting of another of the segments, thereby identifying a conflicting segment;

skewing the display time of the conflicting segment to avoid the reset conflict;

identifying in the sequence a segment before and a segment after the conflicting segment each affected by the skewing of the conflicting segment, wherein the segments before and after the conflicting segment are each of respective bit-planes comprising multiple segments in the sequence;

counter-skewing the display times of segments respectively corresponding to the segments before and after the conflicting segment; and setting start times for each load and reset of each of the segments.

2. A method according to claim 1, wherein the segments before and after the conflicting segment are adjacent the conflicting segment.

3. A method according to claim 1, wherein the respectively corresponding segments are non-adjacent each other in the sequence.

4. A method according to claim 3, further comprising counter-skewing the display times of segments in the sequence between the respectively corresponding segments.

5. A method according to claim 1, wherein the respectively corresponding segments are each before or each after the conflicting segment in the sequence.

6. A method according to claim 1, wherein the respectively corresponding segments are arranged in the sequence in reverse order to the segments before and after the conflicting segment.

7. A method according to claim 1, further comprising skewing and counter-skewing by adjusting a hold-time of the conflicting segment.

8. A method according to claim 1, wherein the conflicting segment is shorter than the load-time of the spatial light modulator.

9. A method according to claim 1, wherein all of the segments are shorter than the load-time of the spatial light modulator.

10. A method according to claim 1, wherein the sequence comprises a subsequence in a larger sequence of segments.

11. A method for providing a load/reset sequence for a display system having a phased reset spatial light modulator having pixels addressable with data by means of loads and resets and having a minimum load-time, the data being formatted in bit-planes, the bit-planes each loaded as one or more segments in a predetermined sequence during a frame-time, the method comprising:

storing a display order of the segments;

determining whether resetting any of the segments conflicts with the resetting of another of the segments, thereby identifying a conflicting segment;

skewing the display rime of all of the segments in the sequence to avoid the reset conflict without counter-skewing; and setting start times for each load and reset of each of the segments.

12. A method according to claim 11, wherein the sequence comprises a subsequence in a larger sequence of segments.

13. A method according to claim 11, wherein the conflicting segment is shorter than the load-time of the spatial light modulator.

14. A method according to claim 11, wherein all of the segments are shorter than the load-time of the spatial light modulator.

15. A method according to claim 11, further comprising skewing by adjusting a hold-time of the segments.

16. A method according to claim 11, wherein the sequence comprises a beginning segment equal to an ending segment.

17. A method for providing a load/reset sequence for a display system having a phased reset spatial light modulator having pixels addressable with data by means of loads and resets and having a minimum load-time, the data being formatted in bit-planes, the bit-planes each loaded as one or more segments in a predetermined sequence during a frame-time, the method comprising:

storing a display order of the segments;

determining whether resetting any of the segments conflicts with the resetting of another of the segments, thereby identifying a conflicting segment;

skewing a subsequence of bit planes including the display time of the conflicting segment to avoid the reset conflict;

identifying in the sequence a segment before and a segment after the conflicting segment each affected by the skewing of the conflicting segment, wherein the segments before and after the conflicting segment are each of respective bit-planes comprising multiple segments in the sequence;

counter-skewing a subsequence of three or more segments bounded by respective bits; and setting start times for each load and reset of each of the segments in the subsequence.

18. A method according to claim 17, wherein the respectively corresponding segments are non-adjacent each other in the sequence.

19. A method according to claim 17, wherein all of the segments are shorter than the load-time of the spatial light modulator.

20. A method according to claim 17, wherein the conflicting segment is shorter than the load-time of the spatial light modulator.

* * * * *